United States Patent [19]

Inagaki et al.

[11] Patent Number: 4,470,688

[45] Date of Patent: Sep. 11, 1984

[54] HEAT ROLLER FIXING DEVICE

[75] Inventors: Sanji Inagaki, Toyokawa; Makoto Sakamoto, Fuji, both of Japan

[73] Assignees: Minolta Camera Kabushiki Kaisha, Osaka; Nitto Kogyo Co., Ltd., Tokyo, both of Japan

[21] Appl. No.: 351,930

[22] Filed: Feb. 24, 1982

[30] Foreign Application Priority Data

Mar. 12, 1981 [JP] Japan ..... 56-36173

[51] Int. Cl.[3] ..... G03G 15/20

[52] U.S. Cl. ..... 355/3 FU; 29/132; 219/216

[58] Field of Search ..... 355/3 R, 3 FU, 14 FU; 219/216, 469, 470; 29/132

[56] References Cited

U.S. PATENT DOCUMENTS 3,539,161 11/1970 Byrne ..... 263/219
4,179,601 12/1979 Tarumi et al. ..... 219/216
4,257,699 3/1981 Lentz ..... 355/3 FU
4,272,179 6/1981 Seanor ..... 355/3 FU
4,329,565 5/1982 Namiki et al. ..... 219/216

*Primary Examiner*—Fred L. Braun
*Attorney, Agent, or Firm*—Wenderoth, Lind & Ponack

[57] ABSTRACT

A heat roller fixing device for use in an electrophotographic copying apparatus and the like, which includes a heating roller constituted by laminating a fluorine resin layer on an electrically conductive core member through a primer layer and driven for rotation, and a pressure roller constituted by forming an electrically insulative layer on another electrically conductive core member and held in contact with the heating roller for simultaneous rotation with the heating roller so as to fix a positively charged toner image formed on copy paper onto the copy paper by causing the copy paper to pass between the heating roller and the pressure roller. The primer layer is composed of an offset prevention agent containing carbon black by a predetermined amount, preferably 0.4 to 3.0% by weight.

5 Claims, 12 Drawing Figures

| EXAMPLE | Carbon black addition amount (wt.%) | Primer layer resistance (Ω·cm) | Fixing temperature (°C) 140°c 160 180 200 |
|---|---|---|---|
| EXAMPLE 2 | 2.0 | $5 \times 10^2$ | |
| EXAMPLE 1 | 1.5 | $1 \times 10^3$ | |
| EXAMPLE 2 | 1.0 | $3 \times 10^3$ | |
| 〃 | 0.75 | $5 \times 10^3$ | |
| 〃 | 0.5 | $7 \times 10^3$ | |
| 〃 | 0.3 | $2 \times 10^4$ | |
| Comparative data 1 | 0 | $2 \times 10^{12}$ | |
| Comparative data 2 | 0 | $2 \times 10^3$ | |

| Primer | Top coat material | Carbon black addition amount | Kinds of carbon black |
|---|---|---|---|
| DP | PFA | 1.5 | KETCHEN BLACK EC (Lion yushi) |
| MN | " | " | " " |
| " | " | " | MA100 (Mitsubishi chemical) |
| " | " | " | MA 8 ( " " ) |
| " | " | " | SPECIAL BLACK 4 (Degussa) |
| " | " | " | ACETYLENE BLACK (Denki kagaku kogyo) |

HEAT ROLLER FIXING DEVICE

BACKGROUND OF THE INVENTION

1. Field of the Invention

The present invention generally relates to a heat roller fixing arrangement for use in an electrophotographic copying apparatus, and more particularly, to a heat roller fixing device which includes a heating roller formed by laminating a fluorine resin or fluorine plastic layer on an electrically conductive core member through a primer layer, and a pressure roller constituted by forming an electrically insulative layer on another electrically conductive core member for passing therebetween a copy paper sheet which carries a positively charged toner image formed thereon by the known electrophotographic method, so as to fix the toner image onto the copy paper sheet, and especially, to a heat roller fixing device of a type not applied with an offset prevention agent on the surface of the heating roller.

2. Description of the Prior Art

The heat roller fixing device of the above described type has such advantages that copy material, for example, in the form of a copy paper sheet is provided with a favorable hand feeling after the fixing without soiling thereof by an offset prevention agent, and that, since no means is required for applying the offset prevention agent, the fixing device may be simplified in construction, with a consequent reduction in cost, as compared with heat roller fixing devices which employ the offset prevention agent. On the contrary, however, the heat roller fixing device of the above described type without employing the offset prevention agent has a drawback in that the undesirable offset phenomenon tends to take place very easily. Conventionally, various means have been proposed for preventing the offset phenomenon, for example, by employing a heating roller coated with a fluorine resin layer superior in release properties and heat resistance, as an offset prevention layer for the improvement of releasing between the heating roller and toner, or by proper selection of binder resins for the toner or addition of release agents such as low-molecular weight polypropylene and the like for the improvement of release properties of the toner itself. However, in the fixing devices in which the toner is positively charged, it has been difficult to perfectly prevent the offset phenomenon unless the offset prevention agent is employed.

As a result of various studies and investigations carried out for solving the problems in the conventional arrangements as described above, the present inventors have found that, in the fixing device in which a heating roller constituted by forming a fluorine resin layer on an electrically conductive core member directly or through a primer layer is combined with a pressure roller constituted by forming an electrically insulative layer on another electrically conductive core member, the offset phenomenon takes place only during the initial period of fixing, with the generation thereof being suspended after lapse of a certain period of time, due to such causes that both the heating roller and pressure roller are electrically charged by friction or triboelectrical contact between said rollers or between the respective rollers and copy paper sheets, with the heating roller being started to be negatively charged at the initial stage so as to be positively charged, on the contrary, after lapse of a certain period of time, and that the time period in which the offset phenomenon takes place approximately corresponds to the time period during which the heating roller is negatively charged, and for example, when the device is operated at a fixing speed of 12 sheets/minute, the offset phenomenon takes place for about 10 minutes, during which period, properly copied items can not be obtained. The present inventors have also discovered that, for preventing the negative charging of the heating roller at the initial stage of operation of the fixing device, carbon black may be added to the primer layer, and completed the present invention based on the findings as described in the foregoing.

SUMMARY OF THE INVENTION

Accordingly, an essential object of the present invention is to provide an improved heat roller fixing device for use in an electrophotographic copying apparatus and the like employing positively charged toner, which is superior in offset prevention effect for efficient fixing operations.

Another important object of the present invention is to provide a heat roller fixing device of the above described type, which is simple in structure and accurate in functioning at high reliability.

In accomplishing these and other objects, according to one preferred embodiment of the present invention, there is provided a heat roller fixing device for use in an electrophotographic copying apparatus and the like, which includes a heating roller constituted by laminating a fluorine resin layer on an electrically conductive core member through a primer layer and having heating means incorporated therein so as to be driven for rotation by driving means, and a pressure roller constituted by forming an electrically insulative layer on another electrically conductive core member and held in contact with the heating roller for simultaneous rotation with the heating roller, thereby to fix positively charged toner image formed on copy paper onto the copy paper by causing said copy paper carrying thereon the toner image, to pass between said heating roller and pressure roller. The primer layer is composed of fluorine resin containing carbon black by a predetermined amount.

By the arrangement according to the present invention as described above, an improved heat roller fixing device has been advantageously presented, with substantial elimination of disadvantages inherent in the conventional heat roller fixing devices of this kind.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENT

Figure 1:
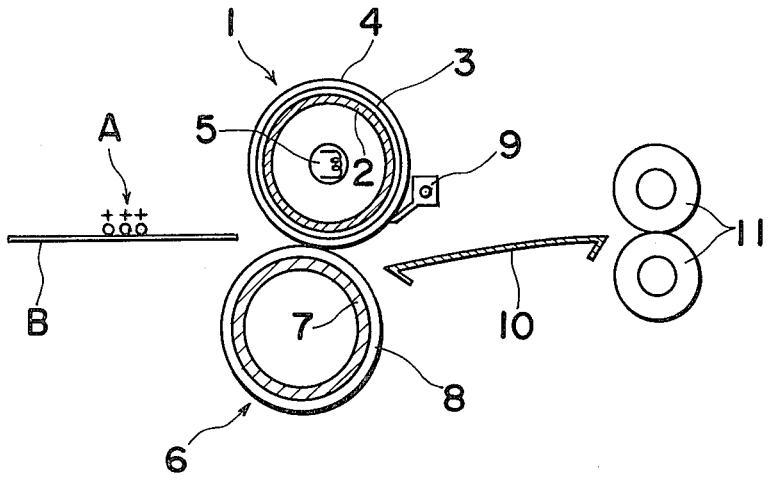
FIG. 1 is a schematic side sectional view of a heat roller fixing device according to one preferred embodiment of the present invention.

In the first place, it is to be noted that the heat roller fixing device according to the present invention includes a heating roller constituted by laminating a fluorine resin layer on an electrically conductive core member through a primer layer and having heating means incorporated therein so as to be driven for rotation by driving means, and a pressure roller constituted by forming an electrically insulative layer on another electrically conductive core member and contacting said heating roller for simultaneous rotation therewith, and is characterized in that, in the heat roller fixing device which is arranged to fix a toner image onto a copy paper sheet by passing the copy paper sheet carrying the positively charged toner image between the heating roller and pressure roller, the primer layer is composed of fluorine resin containing carbon black by a predetermined amount.

As materials for the electrically conductive core member, aluminum, aluminum alloys, iron alloys such as stainless steel, and other metals may be employed.

For the fluorine resin layer, it is preferable to employ fluorine resins superior in heat resistance such as polytetrafluoro ethylene resin (PTFE) represented by the formula

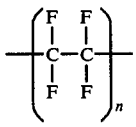

polytetrafluoro ethylene perfluoro alkoxy ethylene copolymer resin (PFA resin) represented by the formula

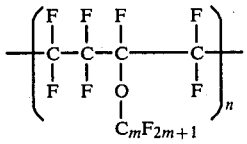

and the like.

Meanwhile, the electrically insulative layer for the pressure roller may be formed by normally employed rubber-like elastic material such as natural rubber, synthetic rubber, etc.

The primer layer may be formed by a primer mainly composed of fluorine resin and commercially available as an adhesive priming agent for the metallic materials such as iron alloys, aluminum alloys, etc., as described above, and more specifically, for example by COOKWEAR A PRIMER WHITE 459-882 (name used in trade and manufactured by Du Pont Co., Ltd., Japan), and MPG-RD (name used in trade and manufactured by Mitsui Phlorochemical Co., Japan). Meanwhile, carbon black to be contained in the primer layer may be any of furnace black, channel black, and thermal black which are, commercially available, for example, as KETCHEN BLACK EC (name used in trade and manufactured by Lion Yushi Co., Ltd., Japan), SPECIAL BLACK 4 (name used in trade and manufactured by Degussa Co., Ltd., Japan), CARBON BLACK MA-100 and MA-8 (names used in trade and manufactured by Mitsubishi Chemical Industries Ltd., Japan), and ACETYLENE BLACK (name used in trade and manufactured by Denki Kagaku Kogyo Kabushiki Kaisha, Japan). Among the above, although KETCHEN BLACK EC and SPECIAL BLACK 4 have been found to be most effective, carbon black to be contained in the primer layer is not limited to these formulations. Such carbon black as described above is added into the primer layer at 0.4 to 3.0% by weight and more preferably, at 0.5 to 2.0% by weight. If the amount of addition is less than 0.4% by weight, the effect of addition is not noticed, while on the contrary, when the amount of addition exceeds 3.0% by weight, uneven coating and clogging of spray nozzles tend to take place due to higher viscosity of the primer paint, thus making it difficult to obtain a primer layer of uniform thickness, with a consequent difficulty in the manufacture.

Referring now to the drawings, there is shown in FIG. 1, a general construction of a heat roller fixing device according to one preferred embodiment of the present invention. In FIG. 1, the heat roller fixing device generally includes a heating roller 1 driven for rotation by a suitable driving means such as an electric motor (not shown), a pressure roller 6 rotatably provided below and in contact with the heating roller 1 for simultaneous rotation therewith, a separating claw 9 provided to contact the peripheral surface of the heating roller 1 for separation of a copy paper sheet therefrom, a guide plate 10, and a pair of copy paper discharge rollers 11 rotatably provided for discharging the copy paper sheet processed through the rollers 1 and 6 out of the fixing device.

The heating roller 1 further includes a metallic roller 2 as the electrically conductive core member, a primer layer 3 formed on the peripheral surface of the metallic roller 2 by a known method, and a fluorine resin layer 4 further laminated thereon through coating of fluorine resin, with the metallic roller 2 being provided therein with a heater 5 so as to be rotated by the electric motor. Meanwhile, the pressure roller 6 is constituted by forming an electrically insulative layer 8 on the surface of a metallic roller 7 as another core member so as to be held in pressure contact with the heating roller 1 for simultaneous rotation with said heating roller 1. During functioning of the fixing device, the heating roller 1 is heated by the heater 5 up to temperatures suitably set in the range of 140° to 180° C. according to the kinds of toner to be employed.

In the above arrangement, when a copy paper sheet B carrying thereon a positively charged toner image A formed by an electrographic method is supplied between the rollers 1 and 6 so as to be passed therebetween while being held under pressure by said rollers 1 and 6 for fixing the toner image A onto the copy paper sheet B, the undesirable negative charging on the surface of the heating roller 1 is prevented by the action of carbon black in the primer layer 3, and thus, a copied image free from the offset phenomenon may be obtained from the initial stage of the fixing.

Hereinbelow, EXAMPLES are inserted for the purpose of illustrating the present invention, without any intention of limiting the scope thereof.

EXAMPLE 1

By employing an aluminum roller as the electrically conductive core member, a primer layer 3 of 6 μm in thickness containing 1.5% by weight of carbon black was formed on the surface of said aluminum roller by an ordinary method through addition thereto of carbon black (KETCHEN BLACK EC manufactured by Lion Yushi Co., Ltd., Japan, referred to earlier) into a primer paint (MPG-RD manufactured by Mitsui Phlorochemical Co., Ltd., Japan, referred to earlier) with a fluorine resin layer 4 of 30 to 40 μm in thickness being further laminated thereon by the use of PFA resin (described earlier) so as to produce the heating roller 1. Meanwhile, apart from the above, a pressure roller 6 was prepared by covering the surface of an aluminum roller with commercially available silicone rubber, and with employment of the heating roller 1 and pressure roller 6 prepared as described above, the heat roller fixing device as shown in FIG. 1 was constituted. By using the fixing device thus prepared, upon effecting the fixing processing of a copy paper sheet B bearing thereon a positively charged toner image A (in which the toner was mainly composed of styrene acrylic resin, with average particle diameter of 14 μm and charge amount in the range of 10 to 12 μc/g), at a heating roller temperature of 170° C., clear and definite copied items free from the offset phenomenon were obtained from the initial stage. Additionally, apart from the above, copy paper sheets B of A4 size, as they were white without formation of toner images A, were continuously passed between the heating roller 1 (at 170° C.) and pressure roller 6 at a rate of 12 sheets per minute at a speed of 11 cm/sec, and the maximum and minimum surface potentials on the circumference of the heating roller 1 during the above period were measured by a vibrating type surface potentiometer, the results of which measurements are shown in FIG. 2.

COMPARATIVE DATA 1

A heating roller 1 and a pressure roller 6 were prepared in exactly the same manner as in EXAMPLE 1 except that the amount of carbon black in the primer layer 3 was rendered to be zero as in conventional arrangements, thereby constituting the fixing device as shown in FIG. 1. Upon effecting the fixing process under the same conditions as in EXAMPLE 1, the offset phenomenon took place at the initial stage. Moreover, when the surface potential of the heating roller 1 was measured, results as shown in FIG. 3 were obtained.

Figure 2:
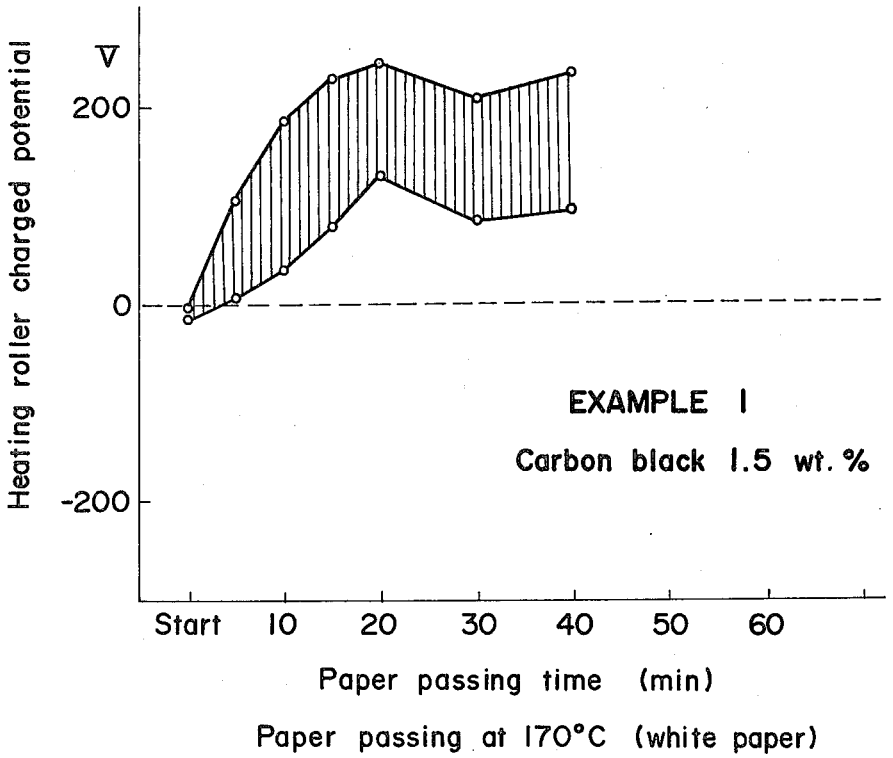
FIG. 2 is a graph showing variations of surface potential of a heating roller in the heat roller fixing device according to the present invention, with the amount of addition of carbon black to a primer layer of the heating roller being set at 1.5% by weight.
Figure 3:
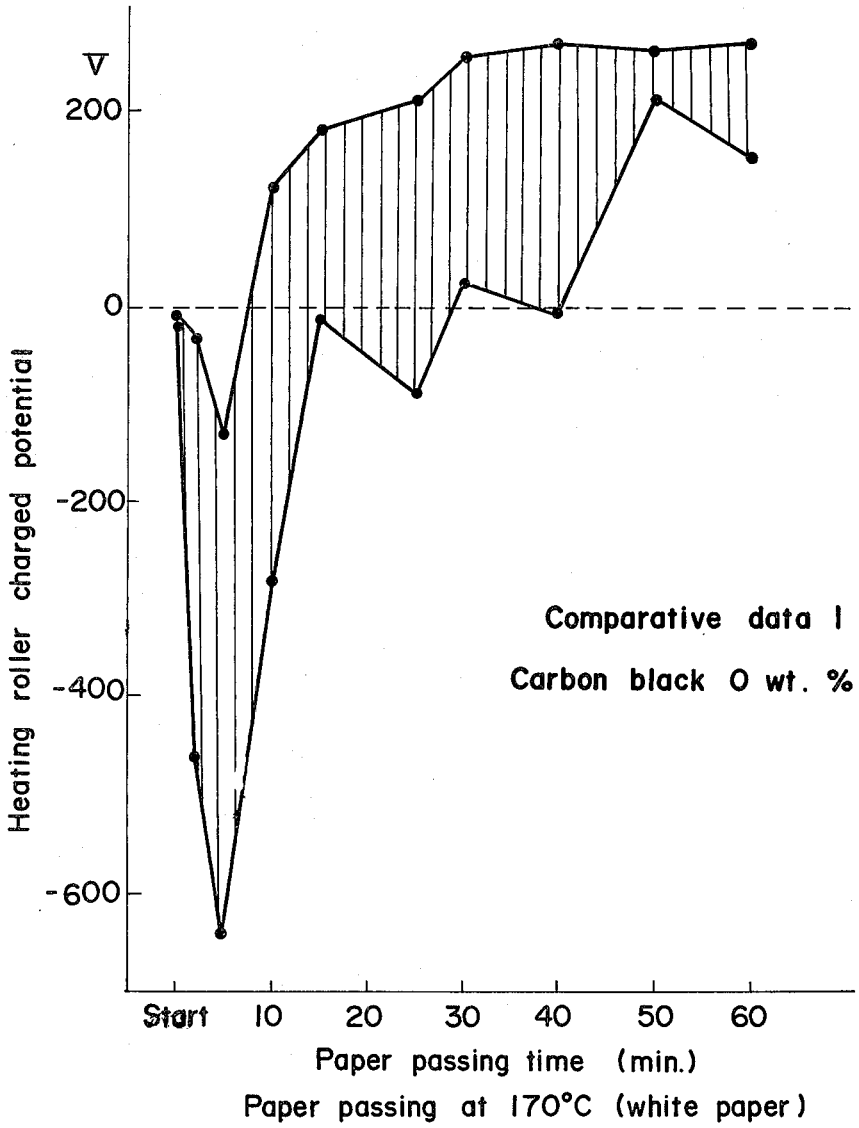
Fig. 3 PRIOR ART
FIG. 3 is a graph similar to FIG. 2, which particularly shows variations of surface potential of a heating roller in the conventional heat roller fixing device as comparative data, with the carbon black addition amount to a primer layer of the heating roller set being at 0% by weight.
Figure 4:
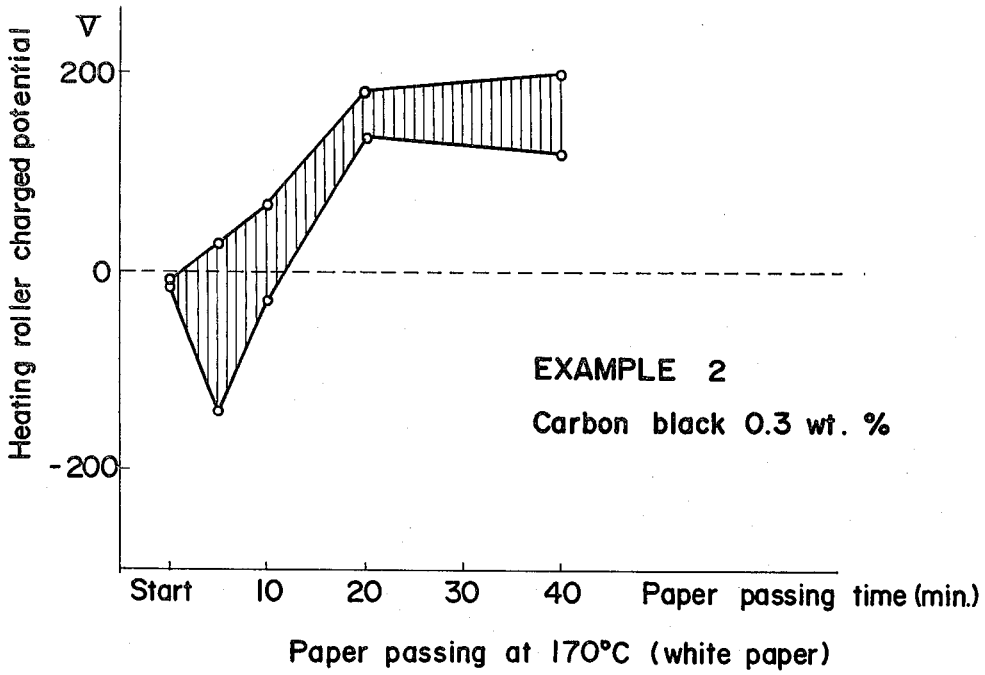
FIGS. 4 through 8 are graphs similar to FIG. 2, which particularly show variations of surface potentials of heating rollers in the heat roller fixing device according to the present invention, with the carbon black addition amounts to primer layers of the heating rollers being set at 0.3, 0.5, 0.75, 1.0 and 2.0% by weight, respectively.
Figure 5:
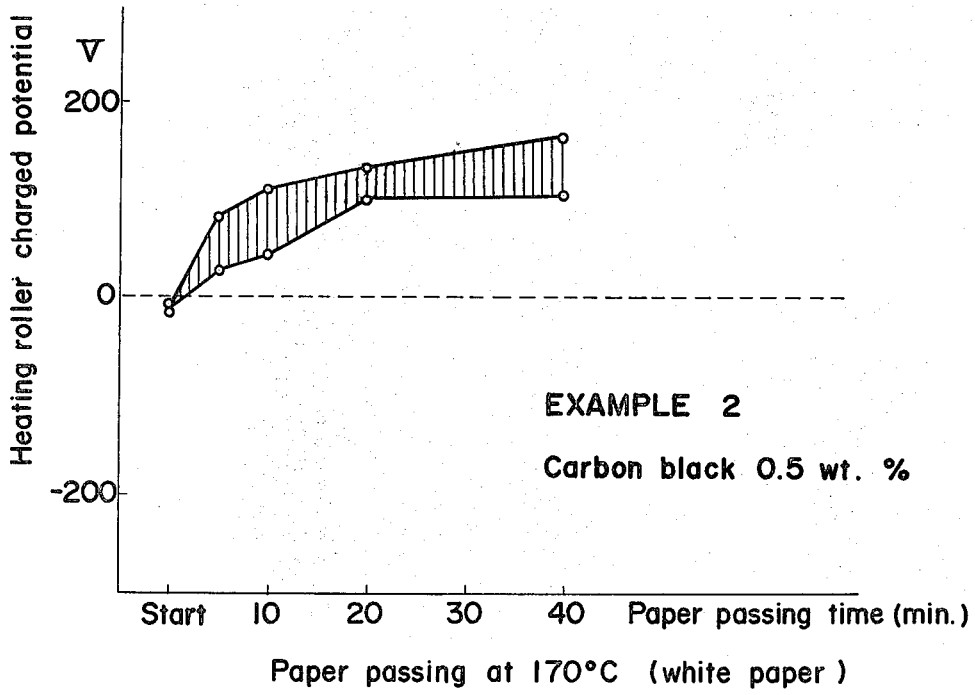
Figure 6:
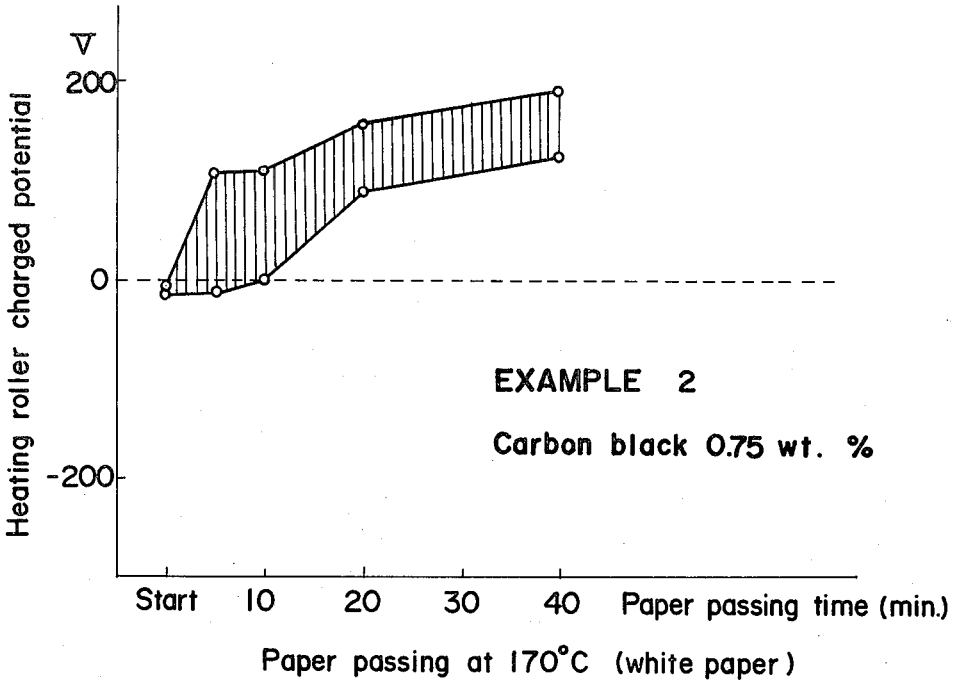
Figure 7:
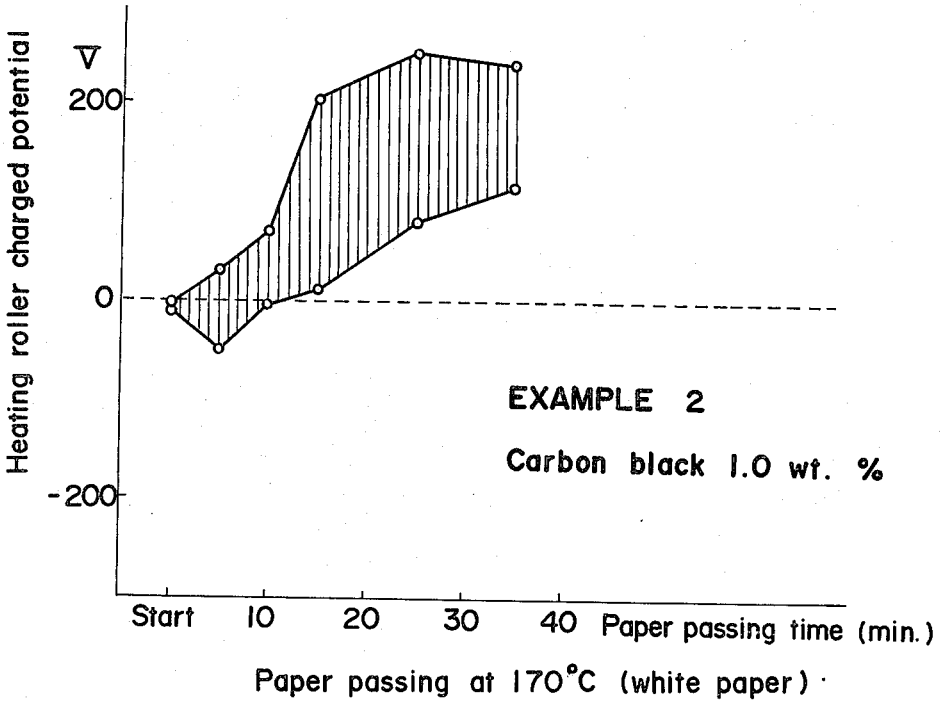
Figure 8:
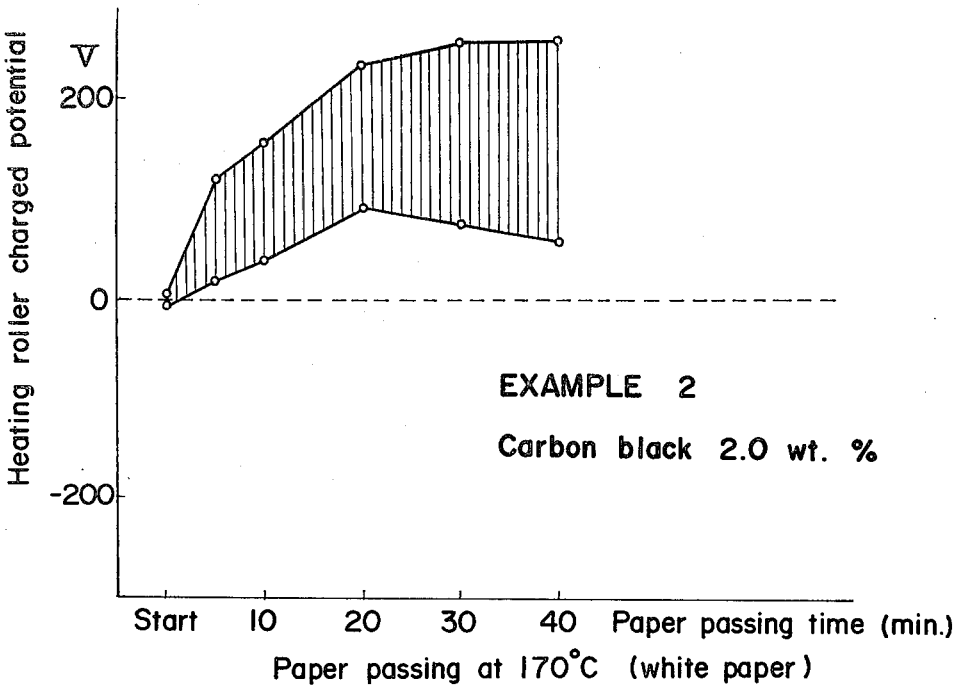
Figure 9:
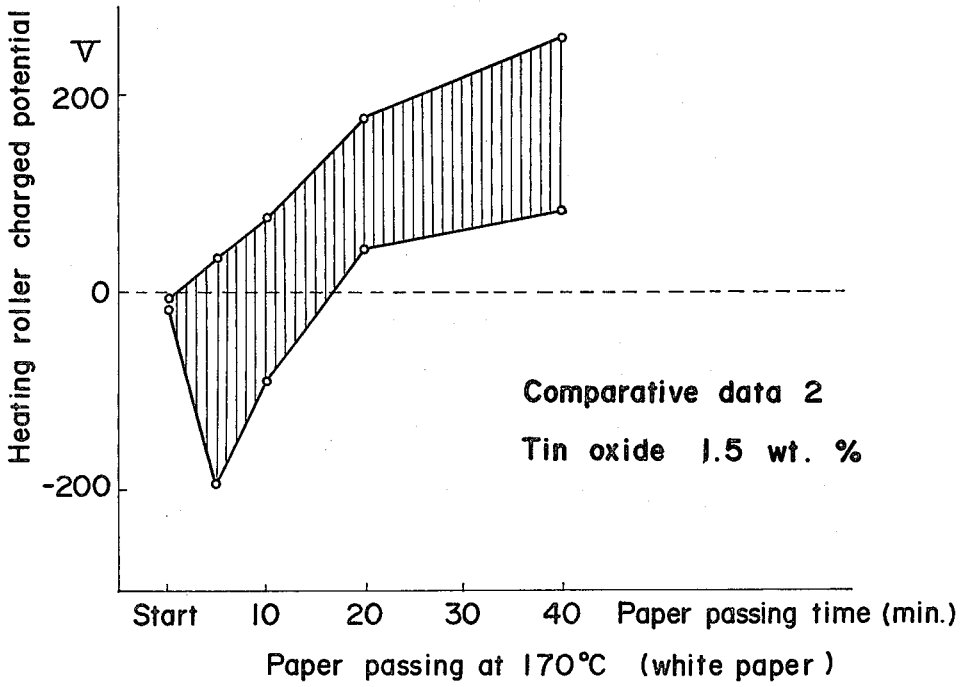
FIG. 9 is a graph similar to FIG. 2, which particularly shows variations of surface potential of the heating roller as comparative data, when the carbon black to be added to the primer layer of the heating roller is replaced by tin oxide at 1.5% by weight.

As is clear from FIGS. 2 and 3, in the conventional arrangement of the comparative data 1 (FIG. 3), potentials on the surface of the heating roller 1 reached the range between −130 to −640 V after continuous passing of copy paper sheets B for 5 minutes, and it is considered that the offset phenomenon takes place due to electrostatic attraction of the positively charged toner A onto the surface of the heating roller 1 through a strong electrostatic force produced with respect to the surface of said heating roller 1. However, after 15 minutes, the heating roller surface potentials were generally reversed to the range from −10 to +180 V. Accordingly, it is presumed that, after lapse of 12 to 13 minutes when the surface potential begins to become positive, the offset phenomenon may disappear even in the conventional fixing device, but, in a device for copying 12 sheets per minute, 60 sheets are to be processed in a continuous passing of copy paper sheets B for 5 minutes, and since the number of copies normally taken at one time is less than the above in most cases, the inversion of the heating roller surface potential after lapse of 12 to 13 minutes does not display its effect in the actual practice.

On the contrary, in the results for the fixing device according to the present invention (FIG. 2), the surface potentials on the heating roller 1 were in the range of −15 to −5 V at the initial stage of starting of the continuous passing of copy paper sheets B, and were reversed to the range of +5 to +100 V after 5 minutes, and thus, the offset phenomenon is suppressed to an extreme extent.

EXAMPLE 2

Heating rollers 1 were produced in the similar manner as in EXAMPLE 1 except that the amount of addition of carbon black was altered respectively to 0.3, 0.5, 0.75, 1.0 and 2.0% by weight, and each of the heating rollers 1 was combined with a pressure roller 6 having the same construction as that in EXAMPLE 1 so as to constitute the heat roller fixing device as shown in FIG. 1.

COMPARATIVE DATA 2

With carbon black in EXAMPLE 1 replaced by tin oxide (1.5% by weight), a heating roller 1 having a primer layer 3 with a resistance of $2\times10$ Ω·cm was prepared in the similar manner as in EXAMPLE 1, and combined with a pressure roller 6 having the same construction as that in EXAMPLE 1 to constitute the fixing device as shown in FIG. 1.

Between the heating roller 1 (170° C.) and pressure rollers 6 respectively prepared in the manner as described in EXAMPLE 2 and comparative data 2, copy paper sheets B of A4 size as they are white without formation of toner images A, were continuously passed at the rate of 12 sheets per minute at a speed of 11 cm/sec, and the maximum and minimum surface potentials on the circumference of the heating roller 1 during the above time were measured by the vibrating type surface potentiometer in the similar manner as in EXAMPLE 1. The results of the measurements are shown in FIGS. 4 through 9, in which the trend is generally similar to that in FIG. 2 for EXAMPLE 1 and FIG. 3 for the comparative data 1, and in FIG. 4 wherein the amount of addition of carbon black is small at 0.3% and in FIG. 9 wherein carbon oxide is replaced by tin oxide, sharp dropping in the heating roller surface potentials is noticed about 5 minutes or so after starting of the continuous paper passing, while in FIGS. 5 through 8 wherein the amounts of addition of carbon black range from 0.5 to 2.0% by weight, the trend is generally favorable as in FIG. 2 for EXAMPLE 1.

Figures 10, 11:
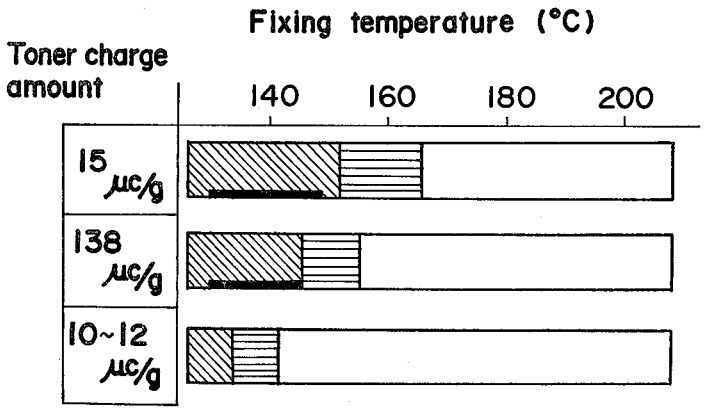
FIG. 10 is a diagram explanatory of the fixing properties of the fixing device according to the present invention and the conventional fixing devices.
FIG. 11 is a diagram showing the relation between the offset properties and toner charge amounts in the fixing device according to the present invention.

On the other hand, the respective heating rollers 1 as prepared in EXAMPLES 1 and 2, and comparative data 1 and 2 were measured for the electrical resistance at their primer layers 3, while copy paper sheets B carrying thereon the positively charged toner images A obtained through developing by the same toner as in EXAMPLE 1 were processed by the respective fixing devices at a rate of 12 sheets per minute for examination of the offset properties after 5 minutes in the continuous paper passing, the results of which are shown in a diagram of FIG. 10.

It is to be noted that, in FIG. 10, offset properties at respective temperatures of the heating rollers 1 as varied in the range including the temperature range normally employed are given, since charged polarities may be affected by a temperature difference, if such a temperature difference is present between contacting objects during contact charging, and that in the diagram of FIG. 10, hatched portions indicate a large degree of offset phenomenon, lateral line portions denote a small degree thereof, and white portions show absence of the offset phenomenon respectively.

As is seen from the results of FIG. 10, improvements in the offset property are not particularly noticed in the small amount of addition of carbon black at 0.3% by weight, while in the amounts of addition at 0.5% by weight and more, marked improvements in the offset property are observed as compared with that in the conventional arrangement of comparative data 1. Additionally, from the result with respect to the fixing device of the comparative data 2 prepared for examining the relation between the electrical conductivity of the primer layer 3 and offset property, since the electrical resistance of the primer layer 3 tends to be lowered upon addition of carbon black to the primer layer 3, it is seen that the electrical conductivity of the primer layer 3 can not be said to be necessarily related to the offset properties.

EXAMPLE 3

The amount of charge of toner to be employed in electrophotography is generally set in the range of 10 to 15 $\mu c/g$ in many cases, since scattering of toner and fogging at the back tend to take place, if the charge amount is small, while lowering of copied image quality such as reduction in (reflecting) density occurs, if the amount of charge is too small, the relation between the charge amount of toner and offset properties was studied with reference to the fixing device of EXAMPLE 1, the results of which are given in a diagram of FIG. 11.

As is seen from the diagram of FIG. 11, in the heat roller fixing device according to the present invention, favorable offset properties are given, even at low temperatures, when toner with a less amount of charge is employed.

Figure 12:
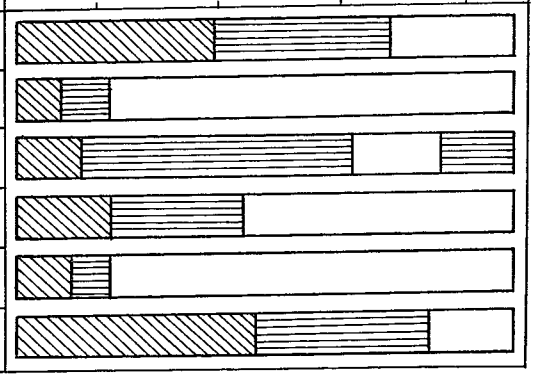
FIG. 12 is a diagram showing the relation between the offset properties and kinds of carbon black employed in the fixing device of the present invention.

Furthermore, the relation between the kinds of carbon black and offset properties were also examined by the use of the fixing device of EXAMPLE 1, with respect to primers of DP (COOKWARE A PRIMER WHITE 459-882, name used in trade and manufactured by Du Pont Co., Ltd., Japan) mainly composed of fluorine resin, and MN (MPG-RD, name used in trade and manufactured by Mitsui Phlorochemical Co., Japan), top coating material of PFA resin, and carbon black addition amount of 1.5% by weight, the results of which are given in a diagram of FIG. 12.

From the diagram of FIG. 12, it is seen that KETCHEN BLACK EC and SPECIAL BLACK 4 with employment of the primer MN show favorable offset properties.

As is clear from the foregoing description, according to the present invention, the undesirable offset phenomenon of the positively charged toner image may be advantageously prevented by including carbon black in the primer layer 3 composed of fluorine resin, with a consequent prevention of soiling of copy paper sheets B due to offset prevention agents, and thus, superior effects such as simplification and cost reduction of the fixing devices, can be achieved.

Although the present invention has been fully described by way of example with reference to the accompanying drawings, it is to be noted here that various changes and modifications will be apparent to those skilled in the art. Therefore, unless otherwise indicated that such changes and modifications depart from the scope of the present invention, they should be construed as included therein.

What is claimed is:

1. A heat roller fixing device for use in an electrophotographic copying apparatus and the like, which comprises:

a heating roller constituted by a first bottom primer layer and a second top fluorine resin layer laminated on an electrically conductive core member through the primer layer, said primer layer including an offset prevention agent containing carbon black in a range of 0.4 to 3.0% by weight, heating means incorporated in said heating roller, driving means for rotating said heating roller, a pressure roller constituted by an electrically insulative layer formed on another electrically conductive core member and held in contact with the heating roller for simultaneous rotation with said heating roller, thereby to fix a positively charged toner image onto copy paper by causing said copy paper carrying thereon said toner image to pass between said heating roller and pressure roller, whereby a copied image free from offset phenomenon is obtained from an initial stage of fixing the copied image onto the copy paper and whereby negative charging on the surface of the heating roller is prevented by the action of the carbon black contained in the primer layer.

2. A heat roller fixing device as claimed in claim 1, wherein the offset prevention agent contains carbon black in the range of 0.5 to 2.0% by weight.

3. A heat roller fixing device as claimed in claim 1, wherein said heating roller is arranged to be heated by said heating means up to temperatures in the range of 140° to 180° C. during operation of the heat roller fixing device, according to kinds of toner employed.

4. A heat roller fixing device as claimed in claim 1, wherein said electrically insulative layer of said pressure roller is formed by a material having rubber-like elasticity.

5. A heat roller fixing device as claimed in claim 1, wherein said electrically conductive core members of said heating roller and pressure roller are made of metallic material.

* * * * *